United States Patent [19]

Calderwood

[11] 4,356,661

[45] Nov. 2, 1982

[54] AEROSTAT AND METHOD OF OPERATION

[76] Inventor: Mitchell C. Calderwood, 3100 Dover Dr., Boulder, Colo. 80303

[21] Appl. No.: 221,970

[22] Filed: Jan. 2, 1981

[51] Int. Cl.[3] ..... A63H 3/06

[52] U.S. Cl. ..... 46/74 R; 46/89; 46/88; 244/94

[58] Field of Search ..... 46/74 R, 89, 88, 87, 46/90; 244/94, 95, 97, 93, 31, 96; 222/206, 207

[56] References Cited

U.S. PATENT DOCUMENTS

| | | | |
|---|---|---|---|
| 1,077,735 | 11/1913 | Morinaga | 46/89 |
| 1,180,584 | 4/1916 | Gajewski | 244/94 |
| 1,538,974 | 5/1925 | Cray | 244/94 |
| 2,579,718 | 12/1951 | Wolman | 222/206 X |
| 2,763,958 | 9/1956 | Lemelson | 46/89 |
| 2,870,570 | 1/1959 | Benson | 46/90 X |
| 2,904,285 | 9/1959 | Huch | 244/94 X |
| 3,063,598 | 11/1962 | Winker | 244/94 X |
| 3,783,551 | 1/1974 | Allison et al. | 46/90 |
| 4,038,777 | 8/1977 | Schwartz | 46/87 |

*Primary Examiner*—Gene Mancene
*Assistant Examiner*—Mickey Yu
*Attorney, Agent, or Firm*—O'Rourke & Harris

[57] ABSTRACT

An aerostat amusement device in the form of a ballast member including a resilient container adapted to contain a liquid such as water and having defined therein an opening sufficiently small to preclude flow of the liquid through the hole as a result of the surface tension of the liquid, but adequate to permit flow of the liquid through the hole in response to a pressure differential induced by deforming the resilient container to thus flow liquid into or out of the container in a carefully controlled manner, the ballast device being adapted to be secured to a balloon filled with buoyant gas to resemble an airship, the ballast device being accurately adjustable to maintain the balloon at a desired height by providing an equilibrium with the buoyant force generated by the balloon.

11 Claims, 4 Drawing Figures

AEROSTAT AND METHOD OF OPERATION

BACKGROUND OF THE INVENTION

1. Field of the Invention

This invention relates generally to aerostat amusement devices and method of operation, and more particularly to a ballast device adapted to be secured to a toy balloon filled with a buoyant gas, the ballast device being in the form of a deformable squeeze container having a small opening defined therein and adapted to meter a liquid through the opening in precise quantities to afford careful adjustment of the ballast in the container to, in turn, precisely counter the buoyant force of the balloon.

2. Description of the Prior Art

Lighter than air devices are of course well known. Functionally, such devices utilize the displacement of an atmospheric volume by a lighter gas contained within a bladder, such as a balloon, to provide a lifting force. For most purposes, such devices may be divided into large "working" balloons adapted to lift individuals or cargo, and toy balloons which may be utilized for amusement, display or other ends in which the ability of a small article to float through the air is of concern. With regard to the toy balloon usage, the balloons were either permitted to fly away through the atmosphere, usually in a mass release of balloons for a display effect, or the balloon would be tethered by a string to preclude free flight. While a weight might be tied to a toy balloon, the small diameter of the buoyant gas molecules, such as helium, would cause sufficient leakage of the buoyant gas in a relatively short time to upset any equibrium initially reached by the weight offsetting the buoyant force of the toy balloon.

Adjustment of ballast in large, working lighter than air devices has of course been highly developed. Heavy flowable materials, such as metal, sand or water, have been included in such devices to permit manual or automatic release of ballast to control the buoyancy of the lighter than air device. In addition to a leakage problem of the buoyant gas, which is of less concern in most large balloons, other more fundamental problems such as expansion or contraction of the buoyant gas in response to heating or cooling, and changes in the atmospheric pressure as a result of substantial changes of altitude, are involved. Accordingly, ballast devices such as taught in the Cray U.S. Pat. No. 1,538,974, or the Winkler U.S. Pat. Nos. 2,983,950 and 3,063,598 have been designed. As with many other teachings relating to working—as opposed to amusement—lighter than air devices, such ballast systems are involved, expensive, and entirely inappropriate for the smaller toy balloon structures to which the instant invention is directed.

SUMMARY OF THE INVENTION

The present invention provides a heretofore unavailable result in that a controllable means for operating a toy balloon as a aerostat is provided, with simple, inexpensive and accurate ballast control means made available. In essence, the ballast device involves a resilient container, such as a plastic squeeze bottle, adapted to contain a liquid ballast material, preferably water. A small hole is provided in the container such that the fluid will not, as a result of surface tension of the fluid, flow through the hole under normal head pressures generated by the presence of fluid. However, when the container is distended to change the internal volume, fluid may be expelled from or ingested into the container, as a result of the pressure or vacuum resulting from such distortion of the container. Further, in view of the small opening, very small amounts of the fluid may be accurately removed to provide for precise adjustment of the overall ballast provided by the device. In most instances, the container, or the ballast device as a whole, is of a form and provided with indicia that replicates larger working devices, such as hot air balloons or blimps, to thereby enhance the amusement value of the device. Attachment to the toy balloon or other similar buoyant structure is preferably of such arrangement as to further lend to the similarity between the toy device and some larger working lighter than air device.

Accordingly, an object of the present invention is to provide a new and improved ballast device which, when attached to a toy balloon or similar buoyant bladder, replicates a large working lighter than air device, such as a balloon, blimp or zeppelin.

Another object of the present invention is to provide a new and improved ballast device and method for operating the device, which permits an easy and rapid adjustment to accurately and precisely establish an equilibrium between the buoyancy of a balloon and the weight of the balloon and ballast device.

These and other objects and features of the present invention will become apparent from the following description.

DESCRIPTION OF THE INVENTION

Figure 1:
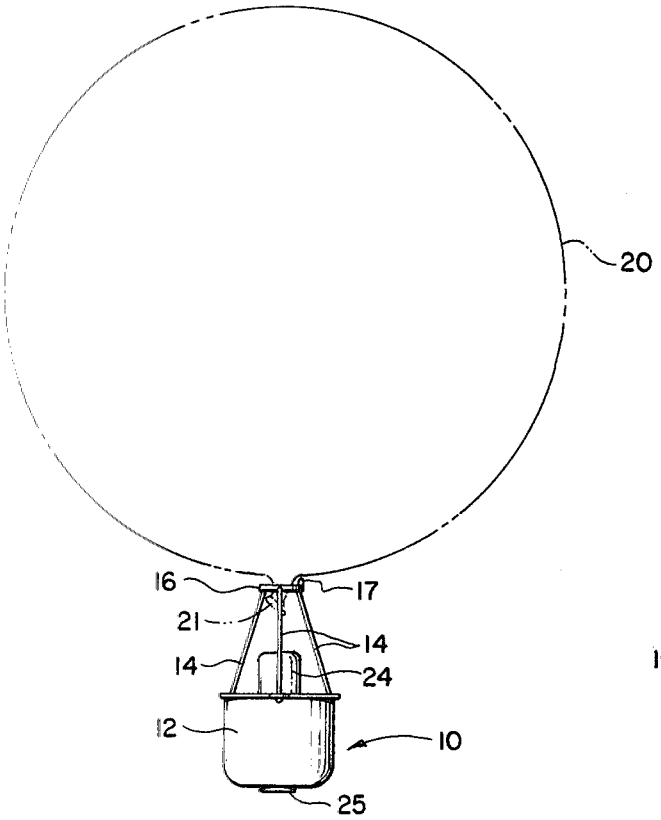
FIG. 1 is a side view of a ballast device in accord with the instant invention illustrating the relationship with a buoyant balloon.

Turning now to the drawings, wherein like components are designated by like references numerals throughout the various FIGURES, a ballast device in accord with the instant invention is illustrated in FIG. 1 and generally designated by reference numeral 10. Ballast device 10 is in the form of a representative gandola basket 12 including a plurality of representative cable members 14 extending between the gondola basket 12 and mounting disc 16. As shown particularly well in FIGS. 2 and 3, mounting disc 16 includes a balance mass 17 thereon and includes a central opening 18 defined therethrough. With reference again to FIG. 1, it will be seen that a balloon 20 may be attached to mounting disc 16 by inserting the balloon inflation member 21 through central opening 18 to attach and seal the balloon 20. It is contemplated that a conventional sealing of member 21 be provided by disc 16. In most cases balloon insertion member 21 tends to be offset to one side and it is the function of balance mass 17 to provide a counterforce such that ballast device 10 depends substantially vertical from balloon 20.

Figure 2:
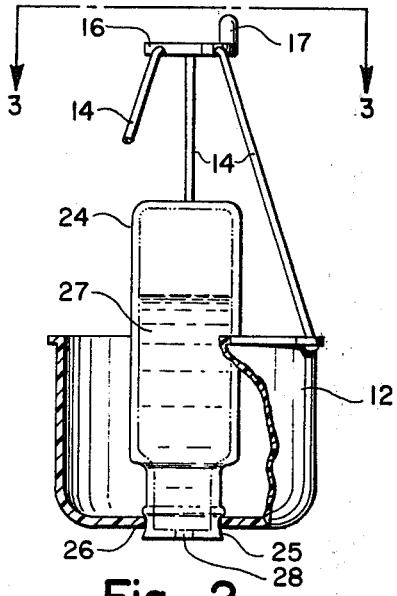
FIG. 2 is a partially cut away view of the ballast device of FIG. 1 with the resilient container shown in section.
Figure 3:
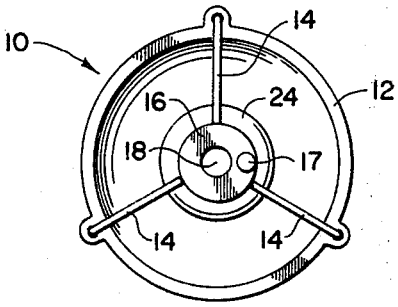
FIG. 3 is a top view taken along lines 3—3 of FIG. 2 illustrating the ballast device of FIGS. 1 and 2.

With reference to FIG. 2, it will be seen that a resilient container 24, which is in essence a plastic squeeze bottle in most instances, is inserted at neck 25 of container 24 into gondola hole 26 defined centrally at the bottom of gondola basket 12 to extend therethrough. A liquid 27 is provided within resilient container 24 with the amount of liquid being controllable by squeezing resilient container 24 to expel or induce liquid through small opening 28, i.e., about 1/16 inch in diameter, defined at the portion of resilient container 24 extending through the bottom of gondola basket 12. In such a manner the overall weight of ballast device 10 may be carefully controlled thereby permitting an equilibrium between the weight and buoyant force of ballast 10 and balloon 20. Accordingly, the overall structure may be adjusted to float at a predetermined height, and if buoyant gas leaks from balloon 20, the ballast may be quickly and readily adjusted by squeezing a drop or two of liquid 27 from resilient container 24. In this manner balloon 20 and ballast device 10 form a structure closely replicating in appearance a hot air, or other, gondola balloon as actually used for carrying people or cargo. The simulation of such a working device as well as the active involvement in the adjustment of such a device greatly enhances the amusement value of a toy balloon.

Figure 4:
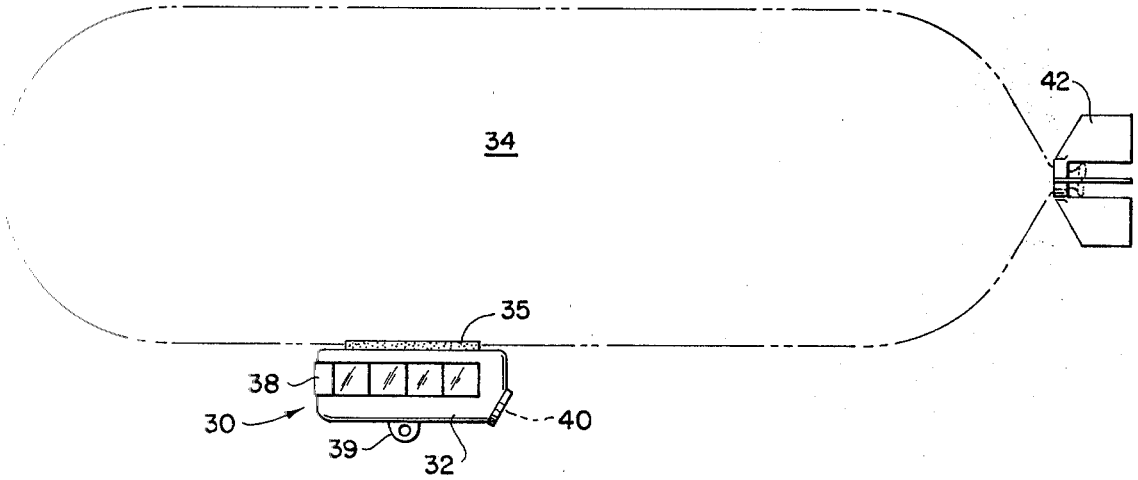
FIG. 4 is a side view of yet another embodiment of a ballast device in accord with the instant invention.

Another functionally similar but different appearing embodiment of the invention is illustrated in FIG. 4 wherein ballast structure 30 is in the form of a resilient container in the shape of a blimp cockpit 32 and attached to balloon 34 by attachment means 35, which may be, for instance, two-sided foam tape, to simulate a blimp airship. The appearance of a blimp airship may be enhanced by providing indicia 38 in the form of cockpit windows, and a securing line opening 39, which functionally serves as an attachment point for a string if operation in this mode is desired. Small opening 40 is defined in cockpit 32 to permit addition or release of controlled amounts of ballast liquid, and is entirely analogous to the embodiment of FIGS. 1 through 3 as to the function of the liquid containing cockpit structure 32. To enhance the appearance of a blimp, tailfins 42 may be employed to seal the opening of balloon 34.

From the above illustation and discussion, it will be understood that the instant invention provides for a simple but quite precise means for utilizing a simple toy balloon filled with a buoyant gas as an aerostat, in that the user may readily and accurately adjust the ballast to trim the amusement device for lift, for floating at a predetermined height, or for decent, as well as to compensate for leakage of gas, or other occurances which disrupt equilibrium. The ballast device and method of operation accordingly afford a greatly enhanced interplay between the toy balloon and user thereof, which is preferably further embellished by providing the ballast device in the form of an actual working lighter than air ship model component.

Although only limited embodiments of the present invention have been illustrated and described, it is anticipated that various changes and modifications will be apparent to those skilled in the art, and that such changes may be made without departing from the scope of the invention as defined by the following claims.

I claim:

1. A ballast device for controlling the buoyancy of a toy balloon, the device comprising:

a resilient container adapted to contain at least one selected liquid;

an opening defined in the container and of such dimension as to preclude flow of the selected liquid through the opening under normal head pressures resulting from the selected liquid in the container as a result of the surface tension of the liquid, the dimension being about one sixteenth of an inch across; and means to attach the ballast device to a toy balloon with the container opening positioned away from the toy balloon;

whereby the amount of selected liquid within the resilient container may be precisely adjusted by immersing the opening of the container in the liquid and ingesting liquid into the container by squeezing and releasing the resilient container, or squeezing the container to dropwise expel liquid to thereby adjust the weight of the ballast device as a function of the liquid in the container, and accordingly the buoyancy of the toy balloon to which the ballast device may be attached.

2. A ballast device as set forth in claim 1 in which the means adapted to secure the ballast device to a balloon is particularly adapted to attached to a balloon having an inflation member at an inflation member thereof.

3. A ballast device as set forth in claim 2 in which the particularly adapted means to attach the ballast device to a balloon comprises a disc member having an opening defined centrally therein and adapted to received and seal an inflation member of a balloon.

4. A ballast device as set forth in claim 2 in which the resilient container is contained in a gondola member having an opening defined in the bottom portion thereof, the container extending through the gondola opening with the opening of the container exposed at such gondola opening and in which the gondola member and the particularly adapted attachment means are secured together by elongated cable like members whereby the ballast device replicates a gondola basket.

5. A ballast device as set forth in claim 3 in which a balance mass is provided on the disc member in an offset position thereof to counterbalance the asymmetric placement of an inflation member of a balloon when secured through the disc opening.

6. A ballast device as set forth in claim 1 in which the means to secure the ballast device to a balloon are particularly adapted to attach to the surface of an elongated balloon.

7. A ballast device as set forth in claim 6 in which the resilient container is attached by adhesive to the surface of an elongated balloon.

8. A ballast device as set forth in claim 7 in which the ballast is secured to an elongated balloon having a valve member at one end thereof and in which the valve member of the elongated balloon is sealed with a disc member having fins defined thereon, whereby the ballast member balloon and sealing member replicate a blimp structure.

9. A ballast device as set forth in claim 1 in which the resilient container opening is circular and of a diameter of about one sixteenth of an inch.

10. A method for providing a weight adjustable ballast device on a toy balloon comprising:

attaching a resilient container having a small opening defined therein to a buoyant toy balloon with the opening positioned away from the balloon;

ingesting a liquid into the container by compressively distending the container to expel air, and allowing the container to expand with the opening therein immersed under the surface of a liquid to ingest liquid therein;

maintaining the liquid in the container by means of the liquid surface tension as a result of the small size of the opening in the container; and decreasing the weight of the ballast device by squeezing the container to expel liquid therefrom in a drop by drop fashion through the opening;

whereby the weight of the ballast device may be precisely adjusted by either ingesting or ejecting liquid therefrom.

11. A method for providing a weight adjustable ballast device as set forth in claim 10 in which the liquid is water and the resilient container opening is circular and of a diameter of about one sixteenth of an inch.

* * * * *